US009150332B1

(12) United States Patent
Behrendt

(10) Patent No.: US 9,150,332 B1
(45) Date of Patent: Oct. 6, 2015

(54) AMMUNITION RELOADING SAFETY CABINET

(71) Applicant: Edward Ray Behrendt, Tucson, AZ (US)

(72) Inventor: Edward Ray Behrendt, Tucson, AZ (US)

( * ) Notice: Subject to any disclaimer, the term of this patent is extended or adjusted under 35 U.S.C. 154(b) by 0 days.

(21) Appl. No.: 13/713,644

(22) Filed: Dec. 13, 2012

Related U.S. Application Data

(60) Provisional application No. 61/570,285, filed on Dec. 13, 2011.

(51) Int. Cl.
*F42B 39/00* (2006.01)
*B65D 25/00* (2006.01)

(52) U.S. Cl.
CPC ..... *B65D 25/00* (2013.01); *F42B 39/00* (2013.01)

(58) Field of Classification Search
CPC ..... F42B 39/00; F42B 39/002; F42B 39/22; F42B 39/26; F42B 39/28; F42B 39/30
USPC ..... 312/326, 329, 351, 290, 321.5, 21, 22, 312/27, 29; 206/3, 372, 373
See application file for complete search history.

(56) References Cited

U.S. PATENT DOCUMENTS

| | | | | | |
|---|---|---|---|---|---|
| 1,543,980 | A * | 6/1925 | Blood | 312/290 |
| 2,856,807 | A * | 10/1958 | Stutzman | 86/31 |
| 4,070,075 | A * | 1/1978 | Morgan | 312/249.13 |
| 4,303,158 | A * | 12/1981 | Perkins | 206/373 |
| 4,344,660 | A * | 8/1982 | Molnar et al. | 312/249.13 |
| 4,383,721 | A * | 5/1983 | Knaack et al. | 312/290 |
| 5,202,529 | A * | 4/1993 | Shields | 86/23 |
| 5,497,539 | A * | 3/1996 | Blodgett et al. | 86/19.7 |
| 6,113,202 | A * | 9/2000 | Germano | 312/245 |
| 7,290,655 | B1 * | 11/2007 | Wood | 206/349 |
| D580,653 | S * | 11/2008 | Robaina | D3/272 |
| 2007/0058344 | A1 * | 3/2007 | Baker | 361/695 |
| 2010/0314978 | A1 * | 12/2010 | Manalang et al. | 312/243 |

* cited by examiner

*Primary Examiner* — Steven A. Reynolds
*Assistant Examiner* — Javier A Pagan
(74) *Attorney, Agent, or Firm* — Knobbe Martens Olson & Bear LLP

(57) ABSTRACT

A container for storing firearm cartridge reloading equipment and supplies. The container has a reinforced shelf that a reloading press can be attached to. The container also includes a mounting location for a powder dispenser and a case trimmer. The container can also have additional storage shelves and can have a door and lid that are openable to allow access and light into the interior of the container.

17 Claims, 5 Drawing Sheets

AMMUNITION RELOADING SAFETY CABINET

CROSS-REFERENCE TO RELATED APPLICATIONS

This application claims the benefit of U.S. Provisional Application No. 61/570,285 filed Dec. 13, 2011 entitled Portable Ammunition Reloading Safety Cabinet.

BACKGROUND OF THE INVENTION

1. Field of the Invention

The present invention relates to firearm ammunition loading equipment and, in particular, concerns a safety cabinet for storing hand loading and reloading equipment and supplies where the safety cabinet can be portable.

2. Description of the Related Art

Reloading, otherwise known as handloading, of firearm cartridges is a popular activity among people who recreationally shoot firearms. Typically, this involves placing powder, a primer and a slug or bullet or shot into a cartridge casing. Often, reloading casings results in a cartridge that is cheaper for a shooter to make than purchase a corresponding manufactured cartridge at a retailer. Moreover, reloading cartridges allows the shooter to vary a wide variety of parameters to optimize the performance of the bullet with the individual characteristics of the shooter's firearm. Parameters like the amount of powder, the depth to which the bullet is seated etc. can be altered or customized to a particular firearm so that the accuracy of the firearm can be improved.

Reloading does, however, require a fair amount of specialized equipment. One piece of equipment is a press that is used to resize a previously fired cartridge case into the desired shape and size. When a cartridge is fired, the heat a pressure causes the cartridge casing to deform. The press is used with a resizing die that reforms the cartridge casing into a desired size and shape. Typically, the press also removes the primer in this process. The press is also used to seat the slugs or bullets into a case that has been reprimed and loaded with powder using a bullet seating die instead of a resizing die. As a considerable amount of pressure is exerted on the cartridge casing during resizing and bullet seating, the press is typically securely mounted to a workbench and the like.

In addition to the press and dies, there is a considerable amount of additional equipment the reloader has to have. The reloader must also have a scale or powder measuring device to ensure that the correct amount of powder is being placed into the cartridge casing. The reloader must also have a tool for inserting new primers into the casing. The reloader must also have a trimming device that allows the reloading to trim cases that are too long as a result of the resizing process. Moreover, various cleaning and deburring tools as well as calipers, polishing tools and the like are part of a reloader's reloading kit.

Further, the reloading must have dies, bullets, casings, and primers for each caliber of bullet that the reloader intends to reload as well as gun powder. All of this equipment and supplies can take up a considerable amount of room and is difficult to move around. Further, many reloaders prefer to have the equipment and bullet components secured in a secure container due to the inherent dangers of the component parts and supplies.

However, there is a lack of adequate storage containers for reloading equipment. Further, most reloaders mount their press on a fixed workbench as the press has to be securely anchored to be able to exert sufficient pressure on the casings to resize the casing and seat the bullets. As such, most reloading kits owned by reloaders are not portable from one location to another which limits the place where the reloader can reload bullets to the location where the press is anchored.

From the foregoing it will be appreciated that there is a need for a reloading storage container that is capable of storing the reloading components in useable positions and further includes a mounting surface that the press can be anchored to. There is also a need for the container to be easily secured while still permitting access to allow for the reloading of cartridges.

SUMMARY OF THE INVENTION

The aforementioned needs are satisfied by the reloading storage container of the present invention which defines an interior space having at least one shelf. The at least one shelf is dimensioned and mounted to the container to permit a reloading press to be anchored to the shelf to permit resizing and bullet seating of dies using the press positioned within the container. The container in one embodiment includes a front door that opens and can be secured closed. The container in one embodiment includes a top surface that can be opened, to permit both access and light into the interior space of the container. The container may also define mounting locations for other reloading components. For example, the container may define a mounting location for a case trimmer on the door of the case.

From the foregoing, it will be appreciated that the reloading container of the present invention provides a container that can contain most, if not all, of the components pieces of equipment and supplies needed to reload firearm cartridges in a secure manner. The container can also be sized so as to be portable from one location to another so that the press can be used to reload shells at different locations. These and other objects and advantages of the present invention will become more apparent from the following description taken in conjunction with the accompanying drawings.

DETAILED DESCRIPTION OF THE PREFERRED EMBODIMENT

Figure 1:
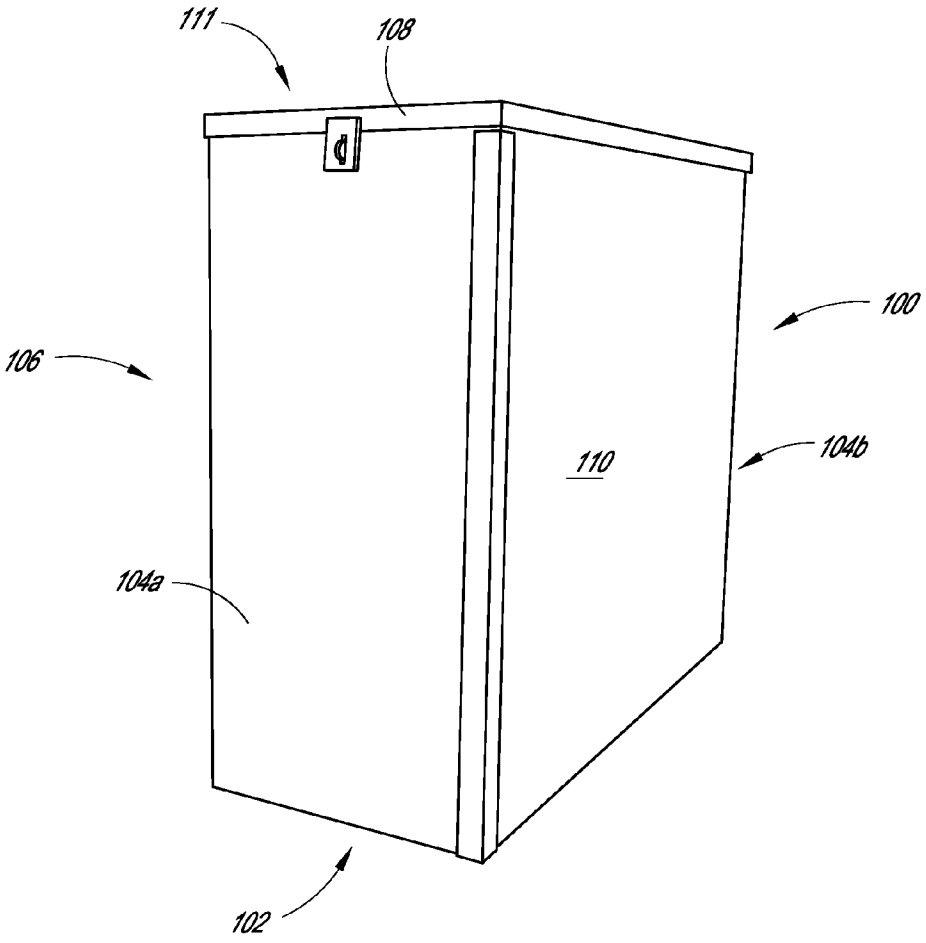
FIG. 1 is a perspective view of one embodiment of a reloading ammunition storage container in a closed configuration.

Reference will now be made to the drawings, wherein like numerals refer to like parts throughout. Referring initially to FIG. 1, one exemplary embodiment of the storage container 100 is shown. As illustrated, the container 100 includes a floor 102, two fixed side walls 104*a*, 104*b*, a back wall 106, a movable top 108 and a movable front door 110. The movable top 108 is preferably hinged at the back wall 106 and the door is preferably hinged at one of the side walls 104*b* so that the top 108 and the front door 110 can be opened allowing access to an interior space 112 of the container 100 in the manner shown in FIG. 2. One example of a hinge 164 that could be used to hinge the top 108 to the back wall 106 and the door to one of the side walls 104*b* is shown in FIG. 3C.

As is also shown, various securing mechanisms 111 can be used to secure the door 110 and top 108 of the container in a closed configuration. These securing mechanisms can be clasps and can also accommodate locks to prevent unauthorized access into the interior of the container 100.

Figure 2:
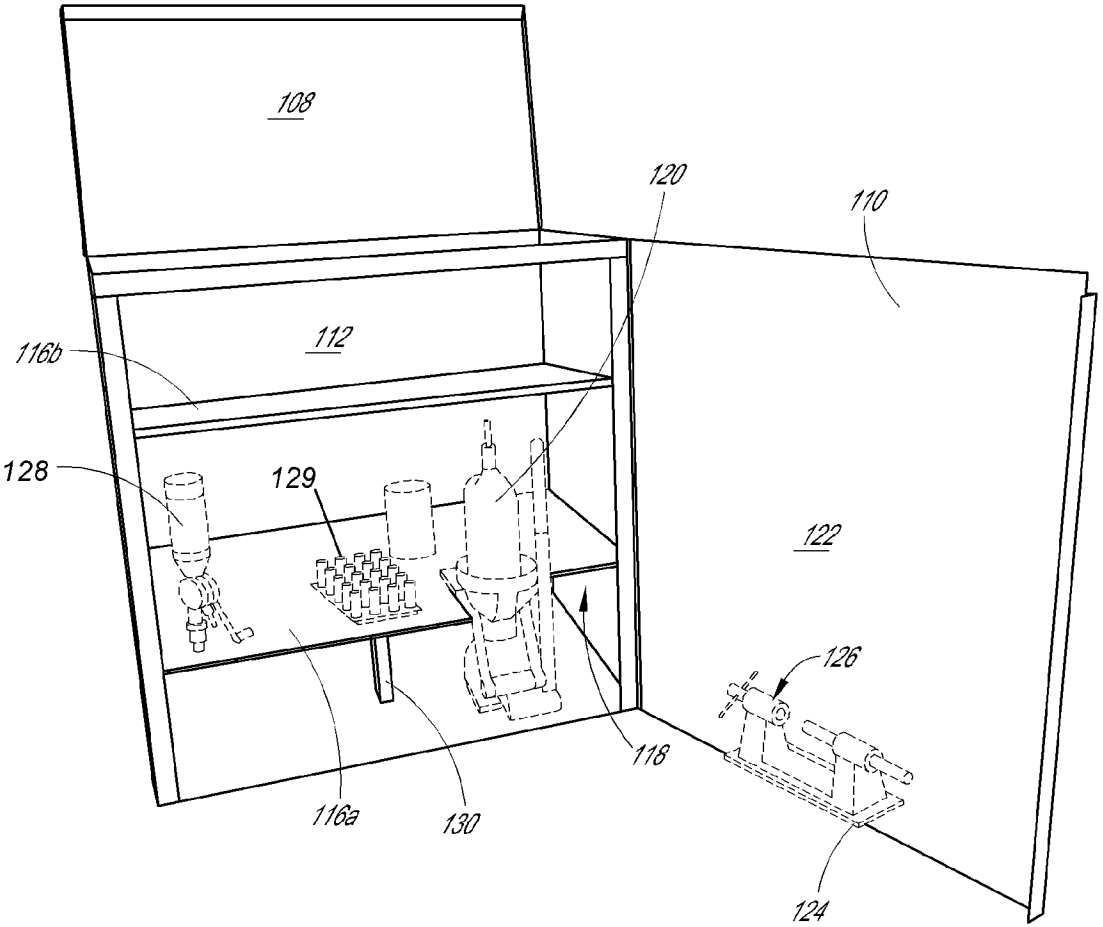
FIG. 2 is a perspective view of the reloading ammunition storage container in an open configuration and FIGS. 3A-3C are dimensioned drawings of the components of the reloading ammunition storage container of FIG. 1.

Referring now to FIG. 2, the interior space 112 of the container 100 is shown. As shown, in this example, there are two shelves 116*a* and 116*b*. The lower shelf 116*a* includes a cut-out region 118 that is recess from the front door 110 of the container to accommodate a press 120. The press 120 is mounted in a cantilevered fashion and the cut-out 118 has a depth sufficient so that the press 120 can be mounted so that a person can make use of the press in seating bullets and re-sizing shell casings with the door 110 open. However, the cut-out region 118 is sufficiently deep that the press 120 is recessed sufficiently to permit the door 110 to be closed in the manner shown in FIG. 1.

The lower shelf 116*a* can also be configured to store a variety of other reloading equipment 128, 129 and supplies. As shown, the shelf accommodates a powder dispenser 128. As will be discussed below in conjunction with FIGS. 3A-3C, various mounting holes can be formed in the shelves 116*a*, 116*b* to accommodate a wide variety of different reloading equipment and supplies.

The upper shelf 116*b* is generally recessed from the door 110 so that light that enters the container 100 when the movable top 108 is open then illuminates at least a portion of the bottom shelf 116*a*. This allows the bottom shelf 116*a* to be used as a workspace for performing tasks such as weighing out powder charges with scales and putting them into the shell casings, inspecting, measuring and deburring shell casings etc.

The upper shelf 116*b* can also be used to store components such as bullets, primers, funnels and other cleaning tools. Powder can also be stored on either of the shelves 116*a*, 116*b*. Additional supplies and equipment can also be stored on the bottom surface 102 of the container 100.

As is also shown in FIG. 2, one or more reinforcing members 130 can extend from the bottom surface 102 to the bottom shelf 116*a*. As the press 120 is mounted on the bottom shelf 116*a*, there is a considerable amount of force and leverage that is applied to the bottom shelf 116*b* which can require reinforcing of the shelf 116*b* to inhibit buckling or damage to the shelf 116*b* during re-sizing and bullet seating operations of the press 120.

As is also shown in FIG. 2, an interior surface 122 of the door 110 can also include a shelf 124 that is sized to receive a case trimmer 126. The case trimmer 126 generally has an axially extending cutting member and a holder for the shell casing and the shelf 124 can then extend so as to be long in an axial dimension and less wide so that the case trimmer 126 can be positioned on the shelf 124 and the door 110 closed without interfering with the press 120.

Figure 3A:
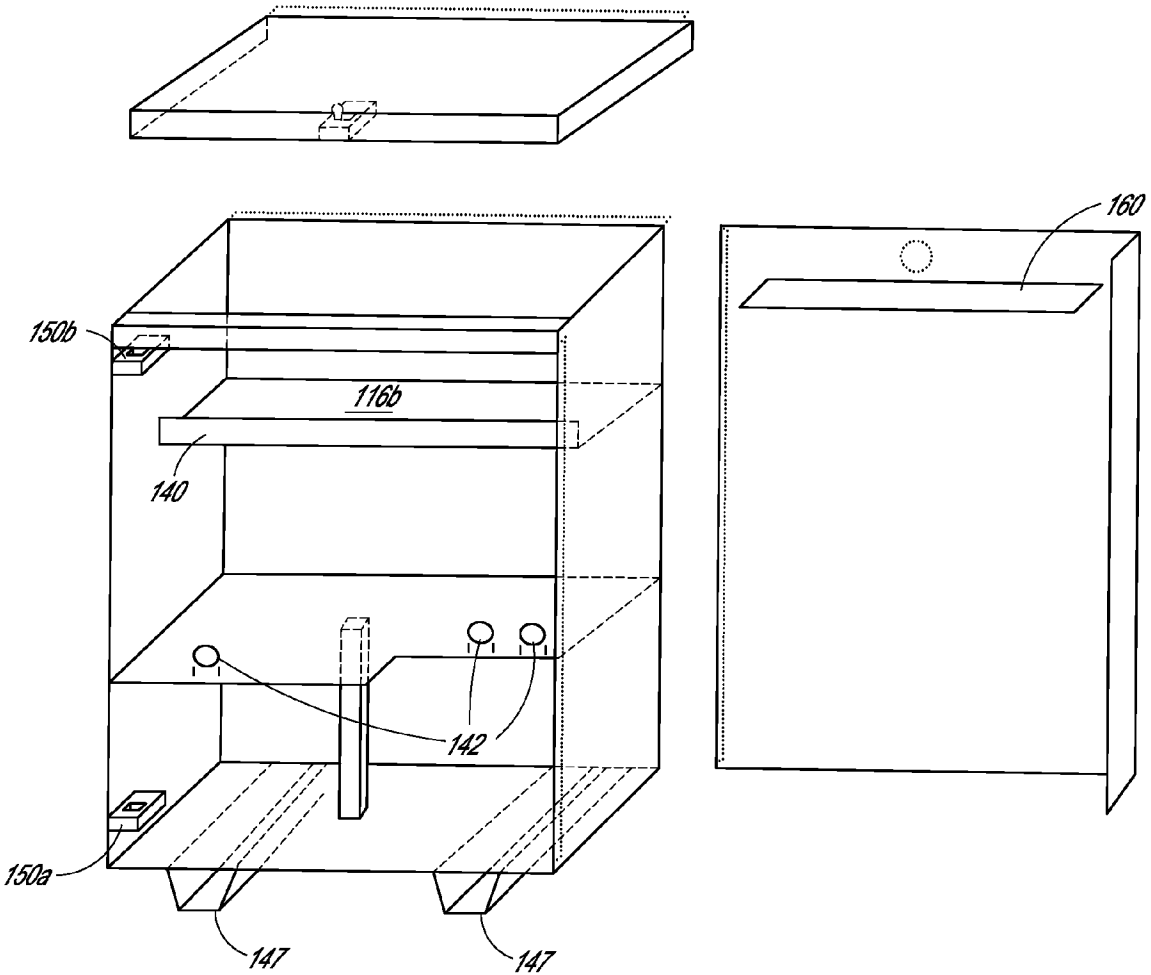
Figure 3B:
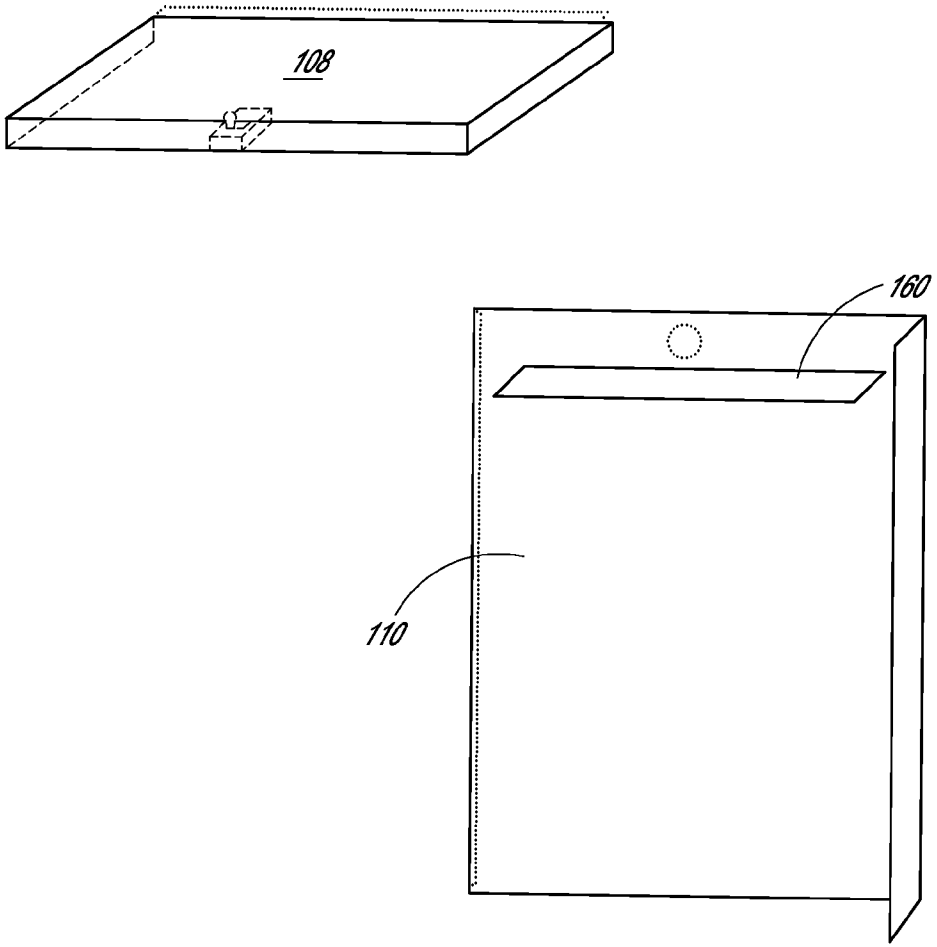
Figure 3C:
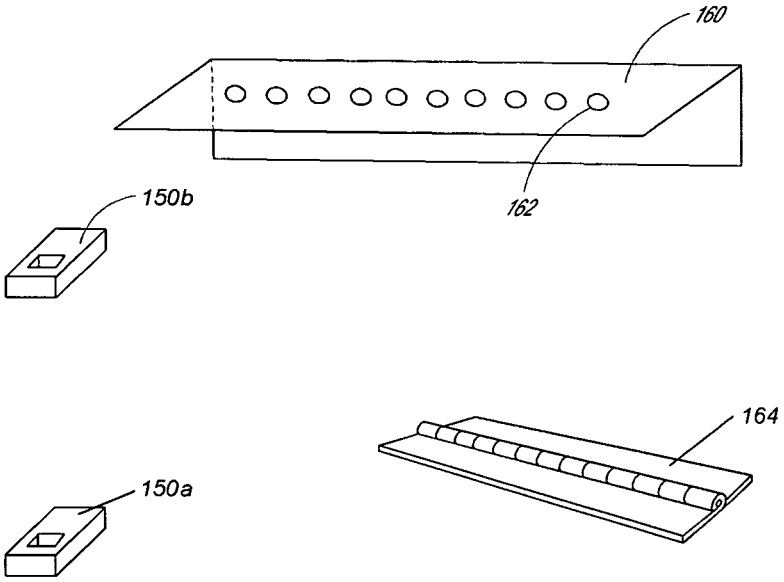

FIGS. 3A-3C are dimensioned drawings of one embodiment of the container 100. It will be appreciated that the dimensions can, of course, change depending upon the application without departing from either the spirit or scope of the present invention and provide an example of one possible implementation of the container 100. As shown in FIG. 3A, the top shelf 116*b* may be equipped with a lip 140 to inhibit items from sliding off of the shelf 116*b*. The bottom shelf 116*a* may include holes 142 for mounting of the press 120 and also mounting of the powder dispenser 128.

Feet 147 can also be formed on the bottom surface 102 of the container 100 to facilitate stable mounting and positioning of the container 100. Moreover, locking members 150*a*, 150*b* can be welded to the side wall 104*a* so that the latch mechanisms can be locked to the locking members 150*a*, 150*b*. A shelf 160 with a plurality of holes 162 can also be mounted to the door 110 so that the shelf 160 can accommodate items like re-sizing and bullet seating dies for different bullet calibers. The door 110 and the lid 108 can also be flanged to facilitate more secure closings of the door 110 and lid 108.

In overall dimensions, one example of the container is 14" deep by 27" tall by 27" wide but these dimensions can vary from ½ of these dimensions to up to 3 times these dimensions. Two shelves 116 are shown, but it will be appreciated that a larger number of shelves can also be accommodated without departing from the scope of the present invention.

It will be appreciated that the container 100 allows for the storage of all reloading related components and supplies. The container also facilitates reloading as the press 120 is securely mounted and all of the needed components and supplies can be positioned nearby in the container 100. The container 100 can also be used to transport the reloading equipment and supplies from one location to another. This allows the reloading equipment to be used to reload cartridges at many different locations, including at the gun range.

It will be appreciated that various changes in the form and use of the described embodiments may be made by those skilled in the art without departing from the spirit or scope of the present invention. Hence, the present invention should not be limited to the foregoing discussion but should be defined by the appended claims.

What is claimed is:

1. A storage container for firearm cartridge reloading equipment, the storage container comprising:

a plurality of walls that define an interior enclosure;

a door that has an open position and a closed position to permit access into the interior enclosure;

at least one shelf that has a recessed section that is recessed from the door a distance that is dimensioned so that when a reloading press is mounted in a cantilevered position in the recessed section, the reloading press does not inhibit the door from being moved into the closed position and the reloading press can be operated while mounted on the shelf within the storage container with the door in the open position;

a lid that has an open and closed position, wherein the lid in the open position provides light to the at least one shelf; and a reinforcing member that extends from a bottom surface of the storage container to the at least one shelf wherein the reinforcing member is positioned within the interior enclosure adjacent the recess so as to be spaced from the walls of the enclosure and wherein the reinforcing member is sized and positioned to prevent the at least one shelf from buckling during operation of the reloading press.

2. The container of claim 1, wherein the door and the lid are secured by latching assemblies.

3. The container of claim 2, wherein the latching assemblies include locking members.

4. The container of claim 1, wherein the at least one shelf comprises a plurality of shelves.

5. The container of claim 1, wherein the at least one shelf defines a mounting location for a gun powder dispenser.

6. The container of claim 1, wherein the at least one shelf includes a reinforcing member that extends from a bottom surface of the storage container to the at least one shelf.

7. The container of claim 1, further comprising a shelf mounted on an interior surface of the door, wherein the at least one shelf is dimensioned so as to receive a case trimmer with the axis of the case trimmer extending in a direction that is parallel to the interior surface of the door.

8. The container of claim 7, further comprising a second shelf mounted on the interior surface of the door wherein the second shelf includes a plurality of openings that are dimensioned so as to receive a plurality of re-sizing and bullet seating dies.

9. A storage container in combination with firearm cartridge reloading equipment, the combination comprising:

a plurality of walls that define an interior enclosure;

a door that has an open position and a closed position to permit access into the interior enclosure;

at least one shelf that has a recessed section that is recessed from the door a distance;

a lid that has an open and closed position, wherein the lid in the open position provides light to the at least one shelf; and a reloading press having an arm mounted on the recessed section of the at least one shelf that is recessed from the door wherein the recessed section is dimensioned so that when the reloading press is mounted in the recessed section, the reloading press does not inhibit the door from being moved into the closed position as the arm extends vertically to as to be positioned within the interior enclosure and the reloading press can be operated while mounted on the shelf within the storage container with the door in the open position; and a reinforcing member that extends from a bottom surface of the storage container to the at least one shelf wherein the reinforcing member is positioned within the interior enclosure adjacent the recess so as to be spaced from the walls of the enclosure and wherein the reinforcing member is sized and positioned to prevent the at least one shelf from buckling during operation of the reloading press.

10. The combination of claim 9, wherein the door and the lid are secured by latching assemblies.

11. The combination of claim 10, wherein the latching assemblies include locking members.

12. The combination of claim 9, wherein the at least one shelf comprises a plurality of shelves.

13. The combination of claim 9, wherein the at least one shelf defines a mounting location for a gun powder dispenser.

14. The combination of claim 13, further comprising a gun powder dispenser mounted in the mounting location.

15. The combination of claim 9, wherein the at least one shelf includes a reinforcing member that extends from a bottom surface of the storage container to the at least one shelf.

16. The container of claim 9, further comprising a case trimmer and a shelf mounted on an interior surface of the door, wherein the shelf is dimensioned so as to receive the case trimmer with the axis of the case trimmer extending in a direction that is parallel to the interior surface of the door.

17. The container of claim 16, further comprising a plurality of reloading equipment and a second shelf mounted on the interior surface of the door wherein the second shelf includes a plurality of openings that are dimensioned so as to receive the plurality of reloading equipment.

* * * * *